US005997178A

United States Patent [19]

Nye et al.

[11] Patent Number: 5,997,178

[45] Date of Patent: Dec. 7, 1999

[54] SELF SECURING TRASH BAG WITH AN INTEGRAL DISINFECTING MEANS

[76] Inventors: Melissa Nye; William Nye, both of 1033 Michael St., Lawrence, Kans. 66049

[21] Appl. No.: 09/027,058

[22] Filed: Feb. 20, 1998

[51] Int. Cl.[6] ..... B65D 33/10

[52] U.S. Cl. ..... 383/33; 383/38; 220/495.08; 220/495.11

[58] Field of Search ..... 383/33, 35, 38, 383/39, 40, 71; 220/495.11, 495.08

[56] References Cited

U.S. PATENT DOCUMENTS

| | | | |
|---|---|---|---|
| 2,202,238 | 5/1940 | Thompson | 383/76 X |
| 2,295,584 | 9/1942 | Larson | 383/33 X |
| 4,105,144 | 8/1978 | Lin . | |
| 4,202,472 | 5/1980 | Lin . | |
| 4,287,701 | 9/1981 | Washington | 383/33 X |
| 4,349,104 | 9/1982 | Hayes . | |
| 4,509,570 | 4/1985 | Eby et al. | 383/33 X |
| 4,738,478 | 4/1988 | Bean, Jr. . | |
| 4,813,791 | 3/1989 | Cullen et al. | 383/40 |
| 4,944,393 | 7/1990 | Cappuzzo et al. . | |
| 4,953,704 | 9/1990 | Cortese | 383/43 X |
| 5,046,604 | 9/1991 | Forhetz et al. . | |
| 5,150,810 | 9/1992 | Loebbert . | |
| 5,232,118 | 8/1993 | Samuel | 220/495.11 |
| 5,351,831 | 10/1994 | Gouge et al. . | |
| 5,556,063 | 9/1996 | Boyd . | |
| 5,588,622 | 12/1996 | Gordon, Sr. . | |
| 5,611,507 | 3/1997 | Smith . | |
| 5,641,138 | 6/1997 | Cronk et al. . | |

*Primary Examiner*—Jes F. Pascua
*Attorney, Agent, or Firm*—Kenneth L Tolar

[57] ABSTRACT

The present invention relates to a trash bag which may be quickly and conveniently secured to a trash bag which further includes an integral disinfecting means therein. The device includes a bag member having an interior surface, an exterior surface, a closed end and an open end. Integral with the periphery of the open end is an elasotmeric band for selectively expanding the diameter or circumference thereof. Attached to the exterior surface of the bag member and overlaying the band is an annular retainer having a plurality of protrusions integral with its outer surface for frictionally engaging the exterior surface of a trash can. The open end of the bag member may be folded about a trash can whereby the integral elastomeric band will compress the retainer tightly against the exterior of the trash can. Attached to the interior surface of the bag member are a plurality of rupturable pods each having an anti-bacterial, anti-fungal or anti-mold substance therein. The pods are covered with a protective foam layer which prevent them from bursting prior to use. A predetermined number of the pods are integrally attached to the foam layer such that when the foam layer is removed the pods rupture. As the weight of trash within the bag increases, the remainder of the pods sequentially burst to release the remaining disinfectant substance within the bag.

8 Claims, 3 Drawing Sheets

SELF SECURING TRASH BAG WITH AN INTEGRAL DISINFECTING MEANS

BACKGROUND OF THE INVENTION

The present invention relates to a trash bag having an expandable rubber gripping member circumferentially adjacent an open end thereof for securing the bag to a trash can with a disinfectant means therein.

DESCRIPTION OF THE PRIOR ART

Trash bags for lining a trash can typically comprise a plastic or polymeric bag member having an opening for receiving trash. The opening is typically folded down around the upper rim of the can to tenuously secure the bag thereto. However, as the weight of trash placed in the bag increases, the bag is typically pulled towards the bottom of the can causing it to collapse therewithin. Some conventional garbage bags have drawstrings on opposing portions of its open edge for selectively closing the opening when the bag is full. However, such devices are inadequate for securing the bag around the can periphery. Trash bag retainers exist but are complicated and inconvenient to use. These retaining devices must be removed and reattached each time the bag is replaced.

In addition, as trash accumulates in the bag, noxious germs and odors are generated thereby which permeate the surrounding area. Accordingly, there is currently a need for a trash bag which may be conveniently secured to a trash can having an odor or bacterial control means integral therewith. Several trash bag devices exist in the prior art, however, such devices do not adequately address the problem described above. For example, U.S. Pat. No. 5,046,604 issued to Forhetz et al discloses an odor absorbing shelf liner.

U.S. Pat. No. 4,944,393 issued to Cappuzzo et al relates to an animal repellant trash bag having a drawstring around its upper periphery and a tear away strip on its interior wall that overlays animal repellant granules. Alternatively, the tear strip overlays the drawstring conduit having the granules therein.

U.S. Pat. No. 4,349,104 issued to Hayes discloses a scented disposal bag which releases a deodorizing material upon pulling the bag drawstring.

U.S. Pat. No. 4,202,472 issued to Lin relates to a bag having an elongated enclosed chamber having insecticide or repellant therein which is ruptured using a pull tab. Alternatively, the insecticide receptacle may include a plurality of recesses each for receiving a different material.

U.S. Pat. No. 5,150,810 issued to Loebbert relates to a waste disposal bag with a bag collar and lid. The collar is made of a relatively rigid material which is firmly attached to the upper end of the bag and the lid is secured to the collar to seal the bag.

U.S. Pat. No. 5,556,067 issued to Boyd relates to a trash bag retaining band comprising a ring formed of an elastic material sufficiently expandible for receiving a trash can. The device has a pair of opposing handles which may be grasped by a user.

None of the above described devices relate to a trash bag having an integral retaining means according to the present invention for conveniently securing the bag to a trash can. Additionally, none of the above described devices have an integral disinfectant means that continuously emits an antibacterial agent or a similar material over a period of time to control noxious germs generated by trash received therein.

SUMMARY OF THE INVENTION

The present invention relates to a trash bag including a bag member having a opening at an end thereof. Integral with the opening is an elastomeric band for selectively expanding or contracting the opening. Surrounding the exterior surface of the bag adjacent its open end is a rubber, annular retainer having a plurality of protrusions, ridges, grooves or similar projections on its exterior surface for frictionally engaging a trash can. The retainer encircles the elastomeric band. Accordingly, the open end of the bag may be folded over the upper rim of a trash can such that the orientation of the band and retainer invert whereby the band tightly compresses the retainer around the exterior of the can to secure the bag member thereto. Attached to the inner surface of the bag is a strip of pods each having a fragile, rupturable exterior surface with an anti-bacterial, anti-fungal or anti-mold agent therein. The pods are covered with a protective layer of foam to prevent the pods from rupturing prior to use. The outer surfaces of a predetermined number of the pods are integral with the protective layer such that removing the foam layer will immediately burst the pods. The remaining pods will gradually rupture as the weight of trash received within the bag increases. It is therefore an object of the present invention to provide a trash bag having an integral retaining means for securing the bag around a trash can.

It is yet another object of the present invention to provide a trash bag having a disinfectant means integral therewith.

It is yet another object of the present invention to provide a trash bag having a gripping means on the exterior thereof for frictionally engaging the exterior periphery of a trash can. Other objects, features and advantages of the present invention will become readily apparent from the following detailed description of the preferred embodiment when considered with the attached drawings and the appended claims.

DESCRIPTION OF THE PREFERRED EMBODIMENT

Figure 2:
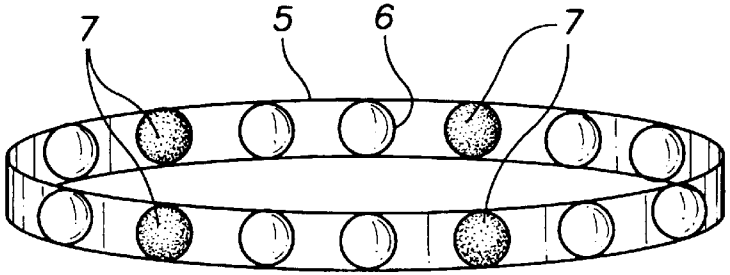
FIG. 2 depicts a strip of rupturable pods according to the present invention.
Figure 1:
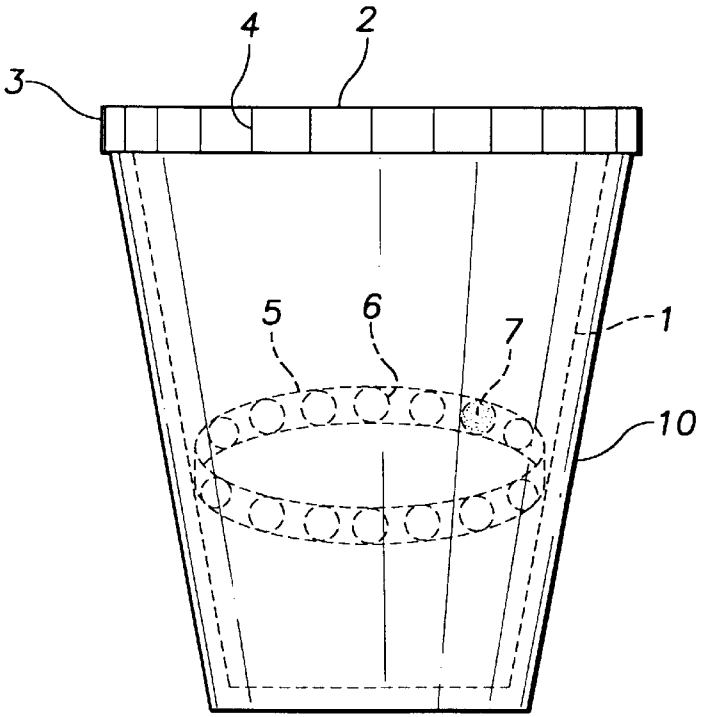
FIG. 1 depicts the device unfolded and received within a household type trash can with the disinfecting means received therein.
Figure 4:
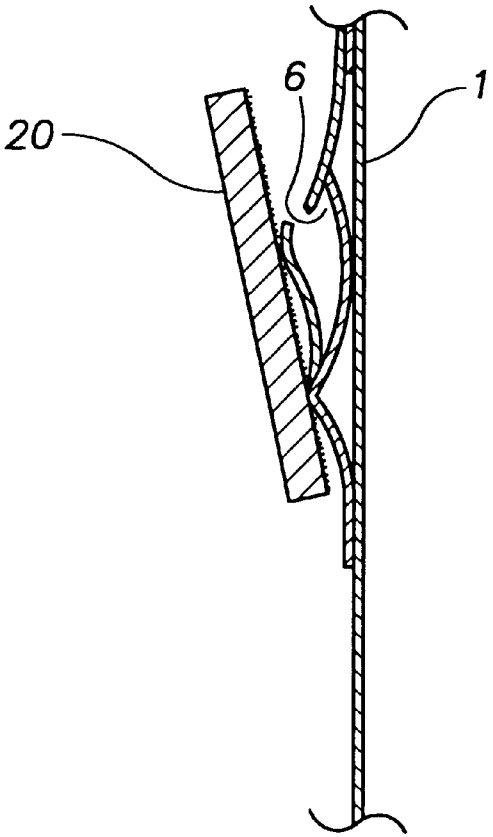
FIG. 4 depicts a sectional view of the bag member, a pod and the foam strip.
Figure 3:
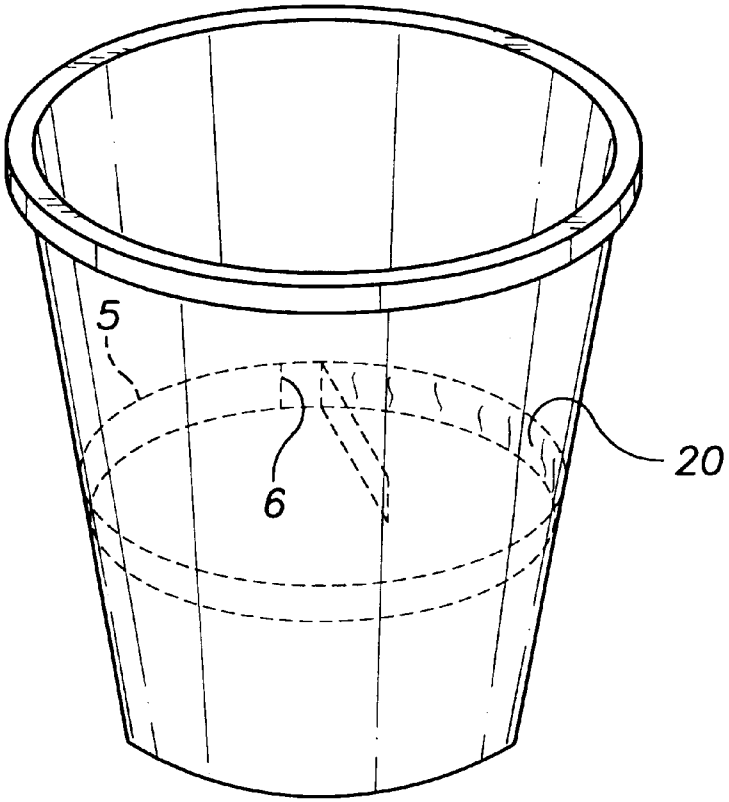
FIG. 3 is a perspective view of a trash can with the bag member installed therein, the foam strip and pod strip depicted in phantom.
Figure 5:
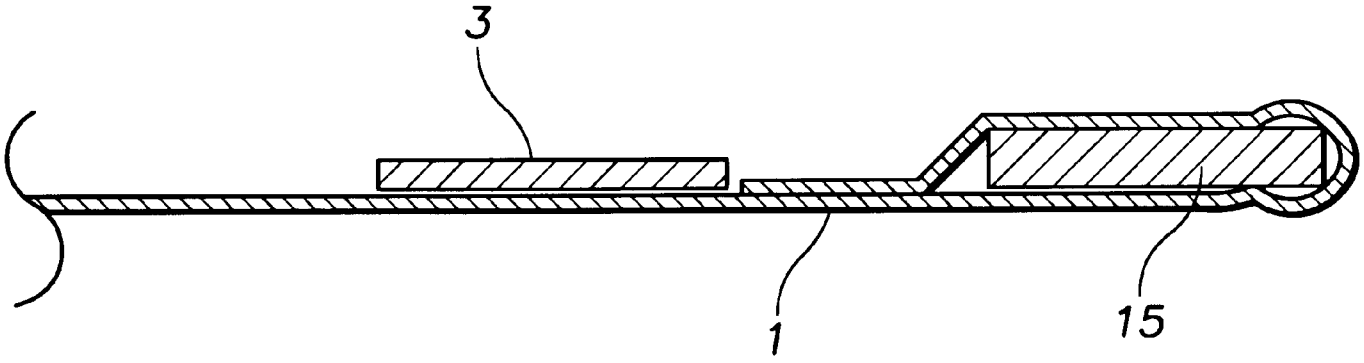
FIG. 5 is a cross sectional view of the bag member.

Referring now to FIGS. 1 and 2, the present invention relates to a trash bag which may be quickly and conveniently secured to a trash can 10. The device includes a bag member 1 having an interior surface, an exterior surface, a closed end and an open end 2. Integral with the bag and adjacent the open end 2 is an elastomeric band 15 for selectively expanding or contracting the circumference of the open end. Preferably, the bag includes two layers with the band sealed therebetween.

Peripherally attached to the exterior surface of the bag member is an annular rubber retainer 3 having an inner and an outer surface. The retainer circumferentially surrounds the band such that the band is concentric therewith. On the exterior surface of the retainer 3 are a plurality of ridges 4 or similar protrusions integral therewith for frictionally engaging the exterior surface of a trash can. Accordingly, the bag member 1 may be inserted into the trash can and the open end 2 is folded over the top rim of the can. The relative orientation of the elastomeric band and the retainer 3 will invert so that the band tightly compresses the frictional rubber retainer against the peripheral exterior of the trash can thereby securing the bag therewithin.

Attached to the inner surface of the bag member or integral therewith is a substantially horizontally oriented strip 5 containing a plurality of rupturable pods 6 each having a fragile exterior surface with a disinfectant substance 7 therein. The disinfectant substance may include, but is not limited to, an anti-bacterial, an anti-fungal or an anti-mold agent. The rupturable pods are peripherally covered with a removable protective foam layer to prevent the pods from rupturing prior to use. The exterior surfaces of a predetermined number of pods are integrally attached to the foam layer 20 such that removing the foam layer bursts the pods thereby releasing the disinfectant substance received therein. As the weight of trash received within the bag member increases, the remainder of the pods will sequentially burst thereby releasing additional anti-bacterial, anti-mold or anti-fungal material within the interior of the bag member.

To use the above described device, the bag is inserted into a trash can and the open end is folded over the top rim of the can. The relative orientation of the integral band and rubber retainer will be inverted such that the band compresses the retainer about the exterior periphery of the can. The foam layer is then removed to rupture a predetermined number of pods thereby releasing a disinfectant agent. As trash is placed into the bag, the weight thereof will gradually burst the remaining pods thereby releasing the remainder of the disinfectant agent.

The above described device is not limited to the exact details described above. The size, shape and materials of construction of the various components may be varied without departing from the spirit of the present invention. Any number of pods may be provided which may be secured to the bag interior or may be integral therewith. The retainer is preferably manufactured with rubber but any suitable flexible but frictional material will suffice.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A trash bag comprising:

a bag member having an interior and an exterior surface, a closed end and an opposing open end;

an elastomeric band adjacent the open end of the bag and integral therewith for selectively expanding the periphery of said open end;

an annular rubber retainer peripherally attached to the exterior surface of said bag member and overlaying said elastomeric band, said retainer including a plurality of integral protrusions on the exterior surface for frictionally engaging the exterior surface of a trash can whereby said open end may be folded over the top rim of a trash can to invert the orientation of said band and said retainer so that said band compresses said retainer tightly against the exterior of the trash can.

2. A trash bag according to claim 1 further comprising a plurality of pods each having a fragile, rupturable exterior surface, said pods attached to the interior surface of said bag member, each having a disinfectant substance received therein.

3. A trash bag according to claim 2 wherein said pods are covered with a removable layer to protect said pods prior to use.

4. A trash bag according to claim 3 wherein said layer is constructed with a foam material.

5. A trash bag according to claim 2 wherein the exterior surfaces of a predetermined number of pods are integral with said protective layer such that removing said layer ruptures said pods.

6. A trash bag according to claim 2 wherein said disinfectant substance is selected from the group consisting of an anti-bacterial agent, an anti-fungal agent and an anti-mold agent.

7. A trash bag according to claim 2 wherein said pods are disposed on a strip attached to the interior surface of said bag.

8. A trash bag according to claim 2 wherein said pods are integral with the interior surface of said bag.

* * * * *